US005718069A

United States Patent [19]

Pelfrey

[11] Patent Number: 5,718,069

[45] Date of Patent: Feb. 17, 1998

[54] FOOTBALL KICKING SHOE

[76] Inventor: Raymond Pelfrey, P.O. Box 2747, Sparks, Nev. 89432

[21] Appl. No.: 648,668

[22] Filed: May 16, 1996

[51] Int. Cl.[6] ..... A43B 5/02; A43B 23/22

[52] U.S. Cl. ..... 36/133; 36/108; 36/76 R

[58] Field of Search ..... 36/102, 76 R, 36/103, 104, 108, 133, 128

[56] References Cited

U.S. PATENT DOCUMENTS

| | | | |
|---|---|---|---|
| 1,221,985 | 4/1917 | Golden . | |
| 1,376,635 | 5/1921 | Pierce . | |
| 1,726,198 | 8/1929 | Stahl . | |
| 2,002,869 | 5/1935 | Riddell | 36/128 X |
| 2,107,667 | 2/1938 | Hermson . | |
| 3,273,266 | 9/1966 | Goldenberg | 36/128 |
| 3,328,030 | 6/1967 | Lee et al. | 36/128 X |
| 3,350,796 | 11/1967 | Bealle . | |
| 3,406,469 | 10/1968 | Dani . | |
| 3,851,410 | 12/1974 | Frazier | 36/133 |
| 4,123,856 | 11/1978 | Lawson . | |
| 4,149,325 | 4/1979 | Pelfrey | 36/133 |
| 4,858,343 | 8/1989 | Flemming | 36/128 |
| 5,461,801 | 10/1995 | Anderton | 36/128 X |

FOREIGN PATENT DOCUMENTS

| | | | |
|---|---|---|---|
| 830912 | 1/1952 | Germany | 36/128 |
| 409890 | 5/1934 | United Kingdom | 36/128 |

*Primary Examiner*—Ted Kavanaugh
*Attorney, Agent, or Firm*—Larson & Taylor

[57] ABSTRACT

An athletic shoe designed for kicker's kicking footballs from the ground having a toe portion that extends upwardly with respect to the horizontal plane formed by the heel and instep of the shoe. The toe has a kicking surface that is substantially flat and perpendicular to the horizontal plane of the heel and instep. Furthermore, the kicking surface is as wide as the widest part of the kicker's foot so that slight misalignment to the left or right of center of the kicker's foot with respect to the ball does not substantially affect kicking accuracy. A shank can be provided on the sole and substantially aligned with the kicking surface to prevent toe and ankle breakdown during kicking. Additionally, a last for forming the kicking shoe having the upwardly extending toe area and substantially flat kicking surface at the frontmost part of the toe area. The last also is as wide at the toe area as the widest part of the shoe.

10 Claims, 3 Drawing Sheets

FOOTBALL KICKING SHOE

FIELD OF THE INVENTION

The present invention relates to an athletic shoe which is designed for kickers, and more particularly to an athletic shoe for kicking footballs from the ground.

BACKGROUND OF THE INVENTION

Heretofore football kickers have used conventional football shoes when kicking footballs from the ground. The problem with kicking balls from the ground with a straight-on kick using conventional shoes is that the kicker must expend extra effort in forcing the toes upwardly to maintain the toes in that position for the kick. This detracts from the energy which the kicker should apply to actually kicking the ball. The structure of the conventional football shoe makes it very difficult for the kicker to force the shoe into a shape where the toe area of the shoe extends angularly upward with respect to the heel and instep portions of the shoe. In addition, conventional kicking shoes have narrowed toes which necessitate extreme accuracy when kicking.

Some kickers have avoided these problems by utilizing the instep, as opposed to the toe, in a soccer-style kick. However, soccer-style kicking has the disadvantage of detracting both kicking force and the kicker's concentration from the kick as a result of having to compensate for the torque generated on the hips, foot and ankle by not kicking the ball straight on using the toe.

SUMMARY OF THE INVENTION

Thus, it is purpose of the present invention to overcome the above-mentioned disadvantages and thereby provide an athletic kicking shoe which eliminates the need for soccer-style kicking and enables kickers to kick balls off the ground in a straight on manner.

In accordance with a preferred embodiment, the kicking shoe includes a toe portion which is upwardly angled with respect to the instep and heel portions of the shoe so that more of a kicker's kicking force and concentration can go into kicking the ball without having to worry about properly angling the toes with respect to the foot when kicking straight on.

It is therefore an object of the invention to provide a kicking shoe which has a substantially perpendicular kicking surface in the toe portion of the shoe with respect to the horizontal plane formed by the instep and heel so that greater surface contact of the shoe can be made on the ball in the longitudinal direction of the ball when kicking.

It is yet another object of the invention to provide a kicking shoe which includes a kicking surface that extends straight out from that part of the shoe that corresponds to the widest part of the foot to provide greater kicking surface area in the lateral direction of the ball to enable greater kicking accuracy when a kicker is misaligned left or right from the center of the ball.

These and other objects of the present invention will become apparent from the detailed description to follow.

BRIEF DESCRIPTION OF THE DRAWINGS

There follows a detailed description of the preferred embodiments of the present invention which are to be taken together with the accompanying drawings wherein.

DETAILED DESCRIPTION OF THE PREFERRED EMBODIMENTS

Referring now to the figures, like elements are represented by like numerals throughout the several views.

Figure 1:
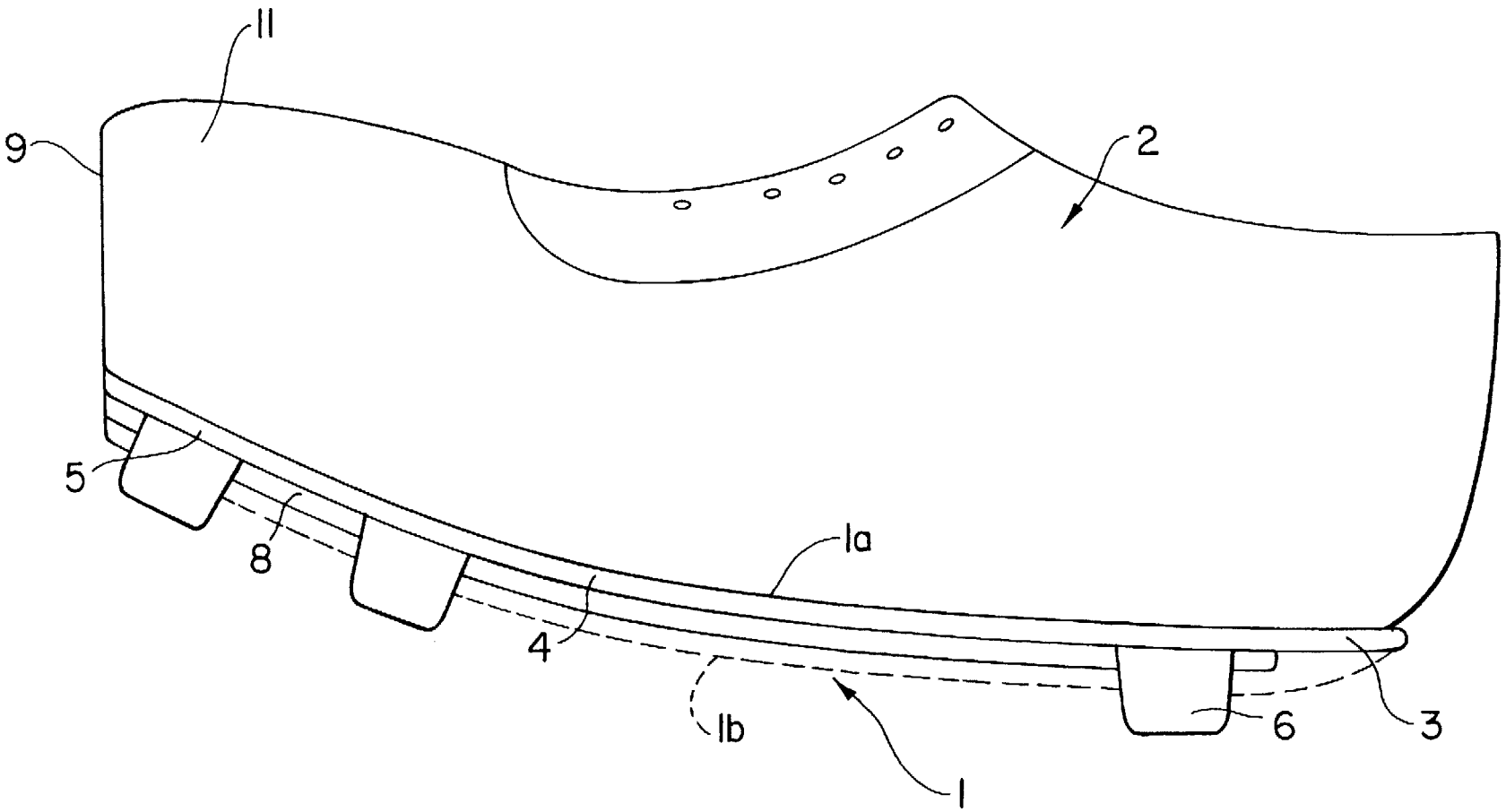
FIG. 1 is a side perspective view of the kicking shoe.

In FIG. 1 there is shown an athletic shoe with the sole shown at 1 and the upper shown at 2. The sole of the shoe comprises a main sole 1*a* having a heel portion 3, instep portion 4, and toe portion 5 and an optional outersole 1*b* shown in dashed lines. The shoe is provided with cleats 6. Shank 8 is depicted as being attached to main sole 1*a* of the kicking shoe so that the front end of shank 8 is substantially aligned with kicking surface 9 which is disposed on toe 11 of upper 2.

Figure 2:
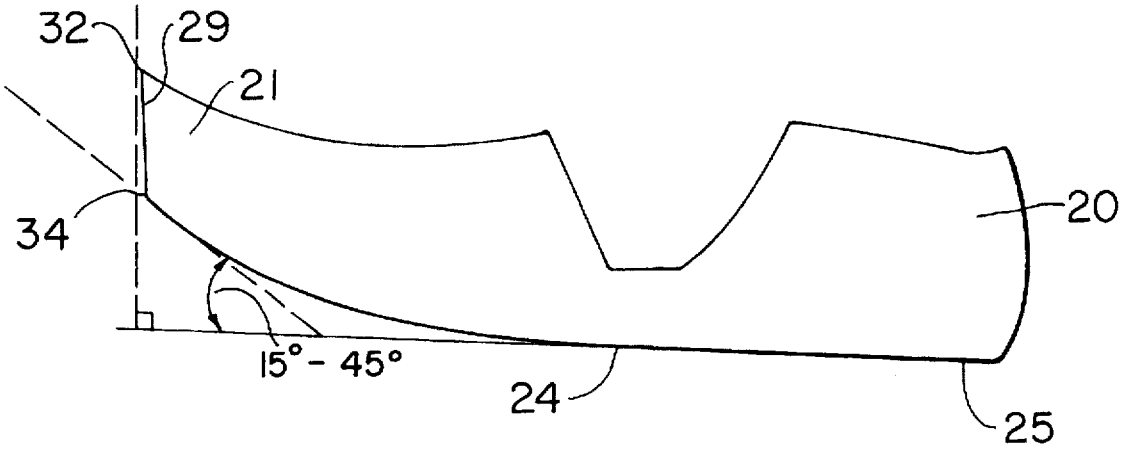
FIG. 2 is a side perspective view of the last which forms the kicking shoe.

The shoe according to the present invention is formed on a last 20 as shown in FIG. 2. The last can be formed of plastic. Toe portion 21 of last 20 is upwardly angled with respect to the horizontal plane formed by instep 24 and heel portion 25 of the sole. This angle is within the range of 15°–45° and most preferably within the range of 25°–38°. Toe portion 11 of the shoe formed by last 20 has an angle corresponding to the angle of the last's toe portion 21.

By providing a shoe which has a normally inclined toe portion, the kicker will need not exert as much muscular effort to force the toes upward to correct the kicking position. Furthermore, more of a kickers concentration can be focused on the act of kicking rather than the act of raising the toes to the proper angle.

As shown in FIG. 2, last 20 has kicking surface 29 for forming the kicking surface 9 of the shoe depicted in FIG. 1. Kicking surface 29 is substantially perpendicular to the horizontal plane formed by instep 24 and heel portion 25 of last 20. It should be noted that, depending upon a particular kicker's style, kicking surface 9 can be formed by altering the angle of kicking surface 29 of last 20 with respect to the perpendicular plane depending upon where an individual kicker prefers to impact the ball when moving his leg. This angle can be adjusted so that if a kicker prefers to impact the ball relatively close to his plant foot, the angle of kicking surface 29 compensates for this by having point 31 extend farther from the remainder of the shoe than point 32. Similarly, if a kicker prefers to place his plant foot comparatively before the ball upon approach, impact will occur comparatively farther from the kicker's plant foot so that kicking surface 29 of last 20 should be angled so that point 32 extends farther from the remainder of the shoe than point 31. Thus, depending on a kickers style, the shoe can be formed so that at the point of impact with the ball kicking surface 29 is substantially flat on the surface of the ball being kicked.

Figure 3:
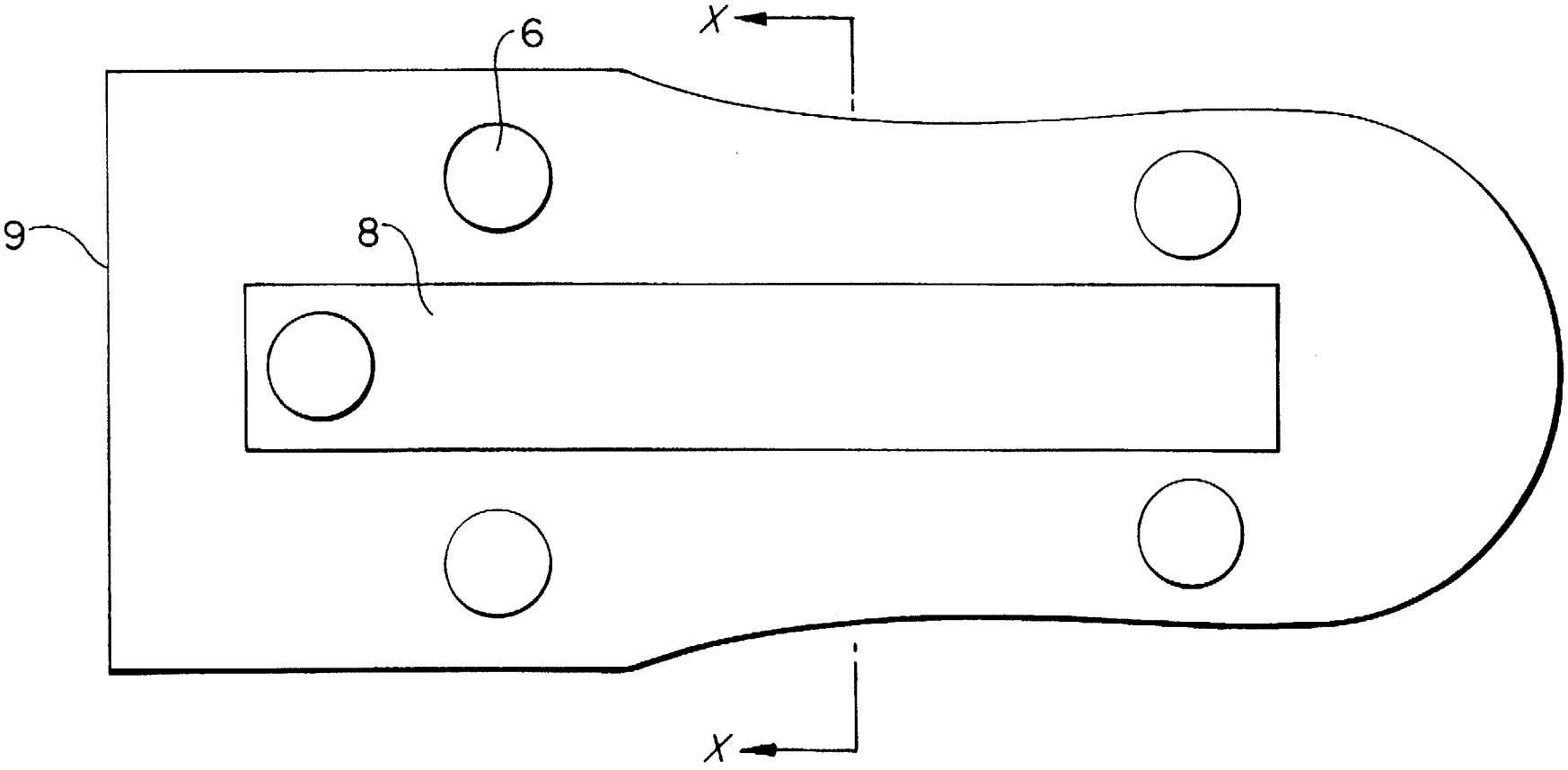
FIG. 3 is a bottom view of the kicking shoe.

FIG. 3 shows a bottom view of the shoe shown in FIG. 1. Shank 8 is depicted as being further back from kicking surface 9 than that position shown in FIG. 1. Line X—X provides orientation for the cross sectional view from the top, as shown in FIG. 4, of the kicking shoe shown in FIG. 1 with outersole 1*b* removed.

Figure 4:
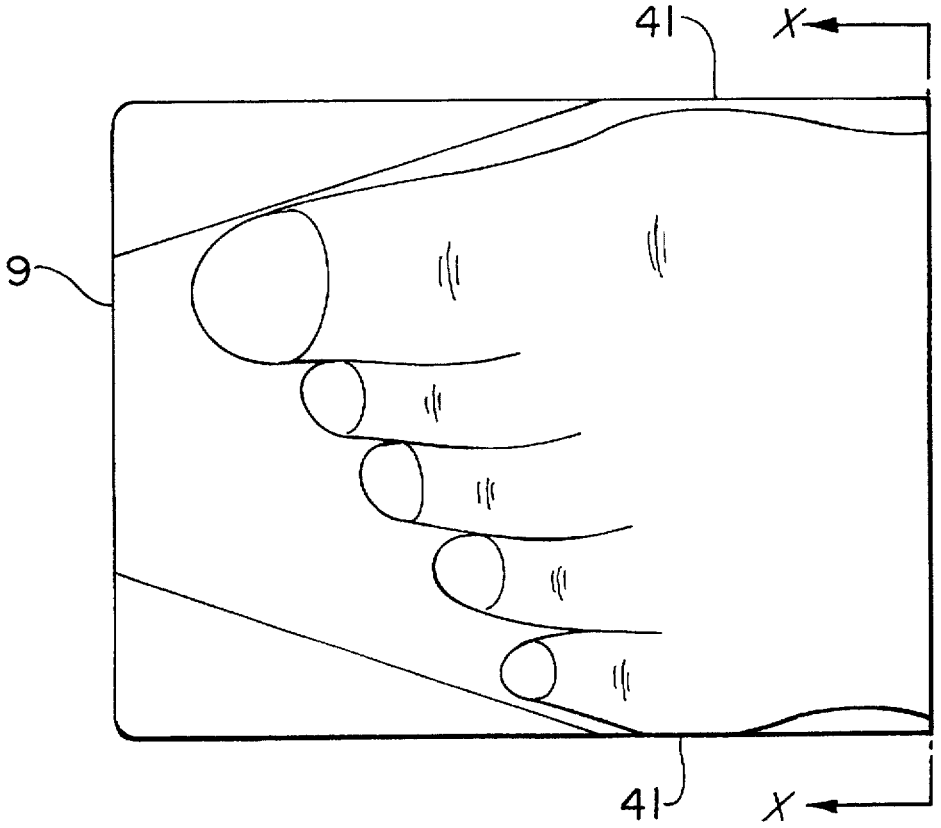
FIG. 4 is a cross sectional view from the top of the front part of the kicking shoe.

FIG. 4 depicts kicking surface 9 as extending straight forward from the widest part 41 of the shoe, which corresponds to the widest part of the foot, in order to provide a greater width of kicking surface 9 than in that which exists in conventional shoes that have relatively pointed or narrowed toes. This extended width allows kickers to sustain kicking accuracy even if the kicking shoe is misaligned slightly left or right of the center of the ball.

Although the invention has been described in considerable detail with respect to the preferred embodiments thereof, variations and modifications will be apparent to those skilled in the art without departing from the spirit and scope of the invention as set forth in the claims.

What is claimed is:

1. A shoe for football kickers comprising:

a main sole having a left side, a right side and integral heel, instep and toe portions, an upper, secured to said sole, having a kicking surface in a toe area, a preformed shank disposed on said main sole, for positioning the shoe in a pre-set impact position and for compensating for ankle and toe breakdown by retaining said pre-set impact position at impact, wherein said main sole and said upper come straight forward on both said left and right sides from the widest part of said main sole, said instep and heel portions remain in a substantially horizontal plane, and said toe portion extends upwardly with respect to said horizontal plane at a 15–45 degree angle with respect to said horizontal plane.

2. A shoe as in claim 1 wherein said upward extension has a 25–38 degree angle with respect to the horizontal plane of the heel and instep portions.

3. A shoe as in claim 1 wherein said kicking surface is substantially flat.

4. A shoe as in claim 3 wherein said kicking surface is substantially perpendicular with respect to said horizontal plane.

5. A shoe as in claim 3 wherein said kicking surface in said to area extends from a bottom of said main sole to a top of said upper.

6. A shoe as in claim 5 wherein said kicking surface is angled such that when a user's foot and leg are in kicking position, the toe is substantially tangential with respect to the surface of the ball.

7. A shoe as in claim 5 wherein said kicking surface is angled relative to said perpendicular, on either side, to compensate for a kicker's kicking style.

8. A shoe as in claim 1 wherein said shank is covered with an outer sole.

9. A shoe as in claim 1 wherein said shank has a front edge that is substantially aligned with a front-most portion of said shoe and a back edge that extends beyond said instep portion.

10. A shoe as in claim 1 wherein said shank has a front edge and a back edge, and both said front and said back edges extend beyond said instep portion of said sole towards said toe portion and said heel portion, respectively.

* * * * *